US005540427A

United States Patent [19]

Nitta et al.

[11] Patent Number: 5,540,427

[45] Date of Patent: Jul. 30, 1996

[54] SHEET CONVEY APPARATUS

[75] Inventors: Tetsuhiro Nitta; Shinji Kanemitsu; Makoto Kashimura, all of Yokohama; Makoto Takemura; Shinya Matsui, both of Tokyo; Toshiyuki Onishi, Yokohama; Yasuhimo Unosawa, Tokyo; Masaru Sato, Yokohama; Hisashi Morioka, Kawagoe; Hiroshi Yoshino, Yokohama, all of Japan

[73] Assignee: Canon Kabushiki Kaisha, Tokyo, Japan

[21] Appl. No.: 390,811

[22] Filed: Feb. 16, 1995

Related U.S. Application Data

[63] Continuation of Ser. No. 141,050, Oct. 26, 1993, abandoned.

[30] Foreign Application Priority Data

Oct. 29, 1992 [JP] Japan ..... 4-291499

[51] Int. Cl.[6] ..... B65H 5/00

[52] U.S. Cl. ..... 271/274; 347/56

[58] Field of Search ..... 271/272, 273, 271/274; 226/186, 187; 347/56; 400/636

[56] References Cited

U.S. PATENT DOCUMENTS

| | | | |
|---|---|---|---|
| 4,269,594 | 5/1981 | Umans et al. | 271/273 |
| 4,676,498 | 6/1987 | Kanemitsu et al. . | |
| 4,772,007 | 9/1988 | Kashimura . | |
| 5,000,439 | 3/1991 | Yoshizawa . | |
| 5,238,235 | 8/1993 | Nitta et al. . | |

FOREIGN PATENT DOCUMENTS

| | | | |
|---|---|---|---|
| 0239317 | 9/1987 | European Pat. Off. | 271/274 |
| 0562808 | 9/1993 | European Pat. Off. . | |
| 1263340 | 5/1961 | France | 271/274 |
| 2327932 | 12/1974 | Germany . | |
| 3293242 | 12/1991 | Japan | 271/274 |

*Primary Examiner*—H. Grant Skaggs
*Attorney, Agent, or Firm*—Fitzpatrick, Cella, Harper & Scinto

[57] ABSTRACT

The present invention provides a sheet convey apparatus having a convey roller contacting with a sheet while rotating to apply a convey force to the sheet, a pinch roller for cooperating with the convey roller to convey the sheet, a support for supporting a center of the pinch roller in its widthwise direction, and a biasing device for biasing the support in such a manner that the support means urges the pinch roller against the convey roller in the widthwise direction of the pinch roller.

40 Claims, 6 Drawing Sheets

SHEET CONVEY APPARATUS

This application is a continuation, of application Ser. No. 08/141,050, filed Oct. 26, 1993, now abandoned.

BACKGROUND OF THE INVENTION

1. Field of the Invention

The present invention relates to a sheet convey apparatus for conveying a sheet.

2. Related Background Art

In recording apparatuses such as printer, copying machine, facsimile machine and the like, an image is recorded on a recording sheet (recording medium) such as a paper sheet, a plastic film and the like by selectively driving energy generating elements of a recording head in response to recording information. The recording apparatus can be grouped into an ink jet type, a wire dot type, a thermal type, a laser beam type or the like in accordance with recording systems. Further, the recording sheet used with the recording apparatus may be not only a normal sheet, but also a thick sheet such as a post card and an envelope or a special sheet such as a plastic film.

As shown in FIG. 9, in a conventional recording apparatus, recording sheets 117 are separated one by one by rotating supply rollers 108 of an automatic sheet supply portion 105, and the separated sheet is fed to a sheet convey apparatus having a convey roller 103 and pinch rollers 107 and then is fed to a recording portion from the convey roller 103. Thereafter, the recording sheet is sent to sheet discharge rollers disposed rearwardly of the convey roller 103 and then is discharged onto a discharge tray.

The conveyance of the recording sheet 117 is effected by urging the recording sheet 117 against the convey roller 103 by a plurality of pinch rollers 117 and by rotating the convey roller 103. A surface of the convey roller 103 is formed from material having high coefficient of friction such as rubber or urethane and a surface of each pinch roller 117 is formed from material having low coefficient of friction such as SUS or Teflon. Each pinch roller 117 is rotatably mounted on both ends 114*a*, 114*b* of a corresponding pinch roller holder member 114. The other end of the pinch roller holder member 114 is rotatably mounted on a chassis 116 and is biased by spring members 109 to urge the pinch roller 107 against the convey roller 103. In order to urge the pinch roller against the convey roller, there have been proposed a method for urging the other end of the bearing of the pinch roller 107 as better dynamic point with respect to the rotation center of the pinch roller holder 114 by a leaf spring, a coil spring and the like, a method for directly urging the bearings at left and right ends of the pinch roller holder as better dynamic points, a method for urging the center of the pinch roller holder and the like.

However, in the conventional sheet convey apparatus, since the bearings of the pinch roller holder are disposed at two points (left and right ends of the pinch roller), the urging forces at the left and right ends of the pinch roller (against the convey roller) are differentiated from each other due to the dispersion in the dimensions of the bearings and the dispersion in the spring forces, with the result that, if the recording sheet is conveyed only by the single pinch roller, the sheet will be skew-fed. Further, since the bearings of the pinch roller holder 114 are disposed at two left and right points, it is feared that the urging force is decreased due to the elastic deformation of the pinch roller holder. In order to prevent the elastic deformation, an additional bearing is must be provided at a center of the pinch roller holder 114. However, in this case (when three bearings are arranged), since the sliding resistance of each pinch roller is increased, the convey accuracy of the recording sheet is badly influenced.

SUMMARY OF THE INVENTION

The present invention aims to eliminate the above-mentioned conventional drawbacks, and an object of the present invention is to provide a sheet convey apparatus in which the alignment of pinch rollers can be effected by a simple mechanism, a recording sheet can be conveyed without reducing the urging force, the skew-feed of the recording sheet can be prevented and the conveying ability is improved.

The other object of the present invention is to make the urging force of a pinch roller against a convey roller uniform without increasing the rotational resistance of the pinch roller and to prevent the skew-feed of a sheet.

In order to achieve the above objects, according to the present invention, there is provided a sheet convey apparatus comprising a convey roller contacting with a sheet while rotating to apply a convey force to the sheet, a pinch roller for cooperating with the convey roller to convey the sheet, support means for supporting a center of the pinch roller in its widthwise direction, and biasing means for biasing the support means in such a manner that the support means urges the pinch roller against the convey roller in the widthwise direction of the pinch roller.

DETAILED DESCRIPTION OF THE PREFERRED EMBODIMENTS

Figure 1:
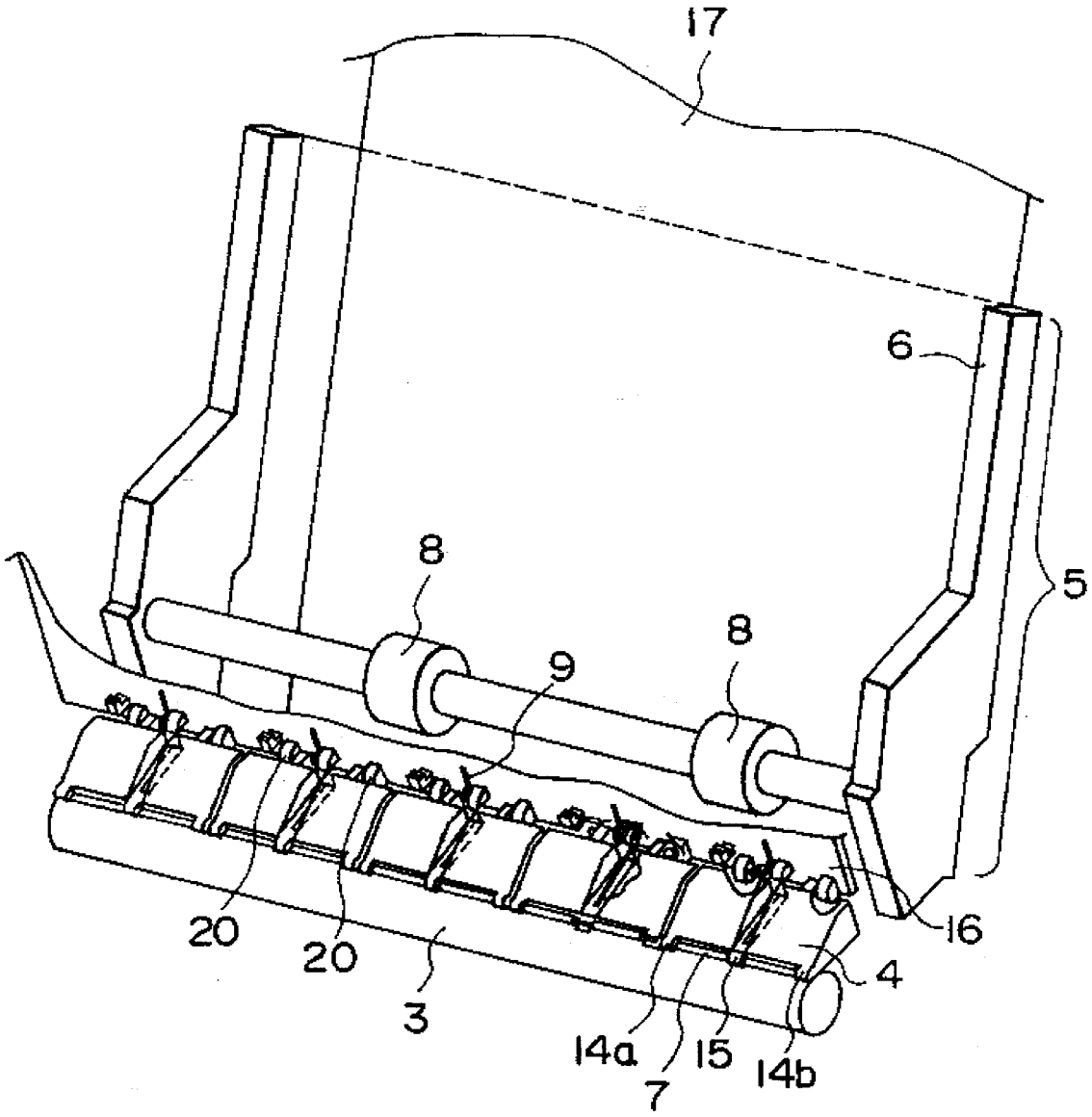
FIG. 1 is a schematic perspective view showing a first embodiment of the present invention.
Figure 2:
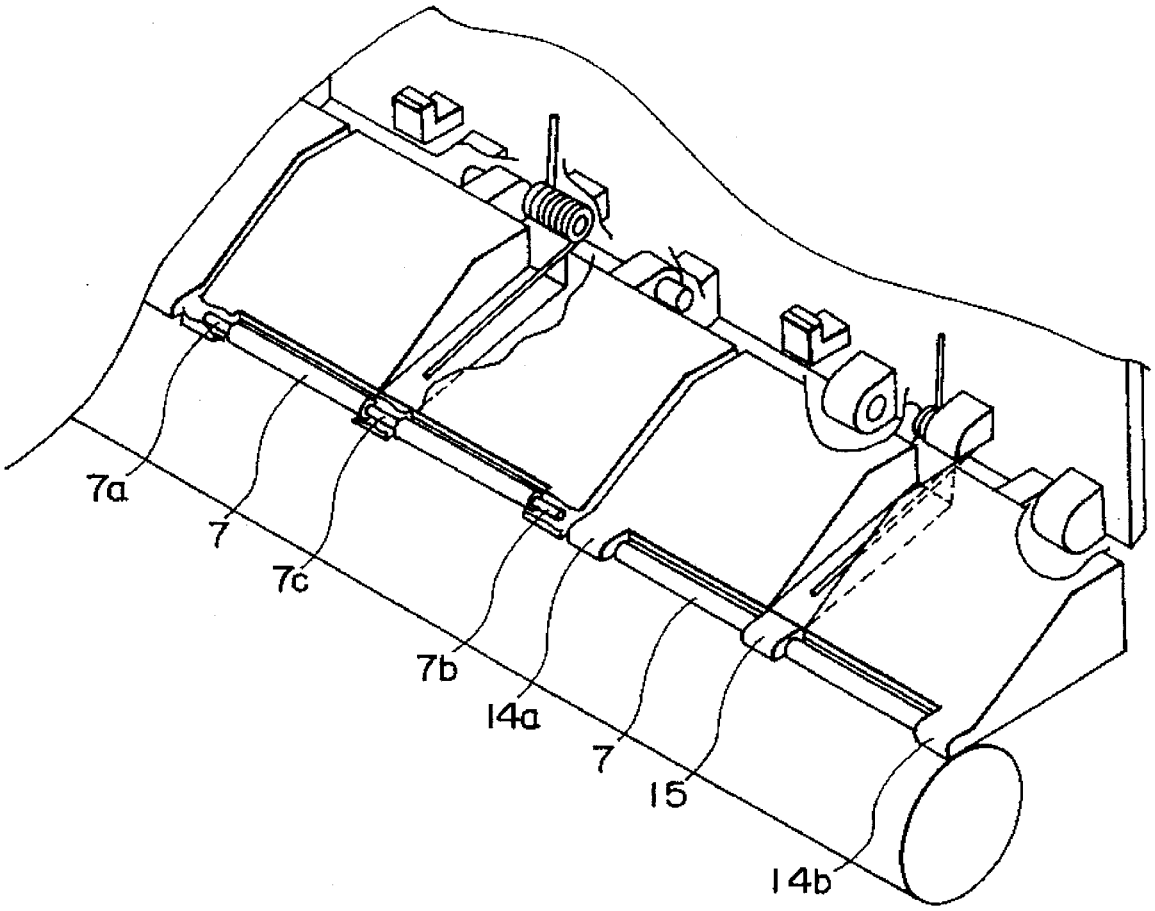
FIG. 2 is an enlarged view of a portion of FIG. 1.
Figure 3:
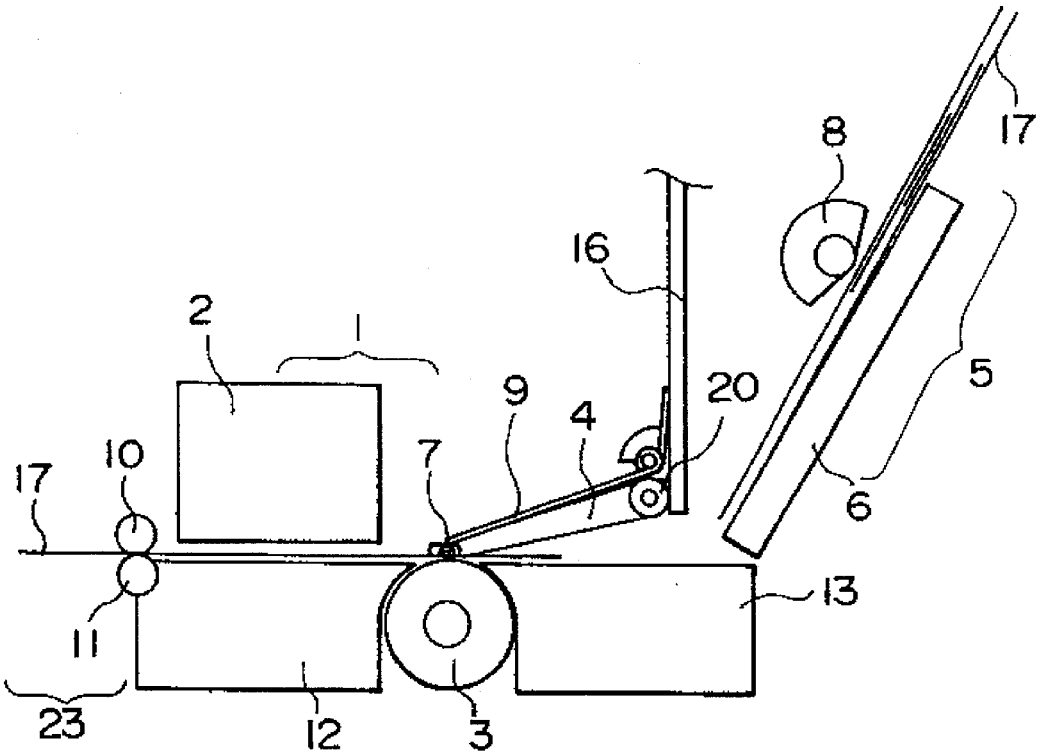
FIG. 3 is a schematic side view showing the first embodiment.
Figure 4:
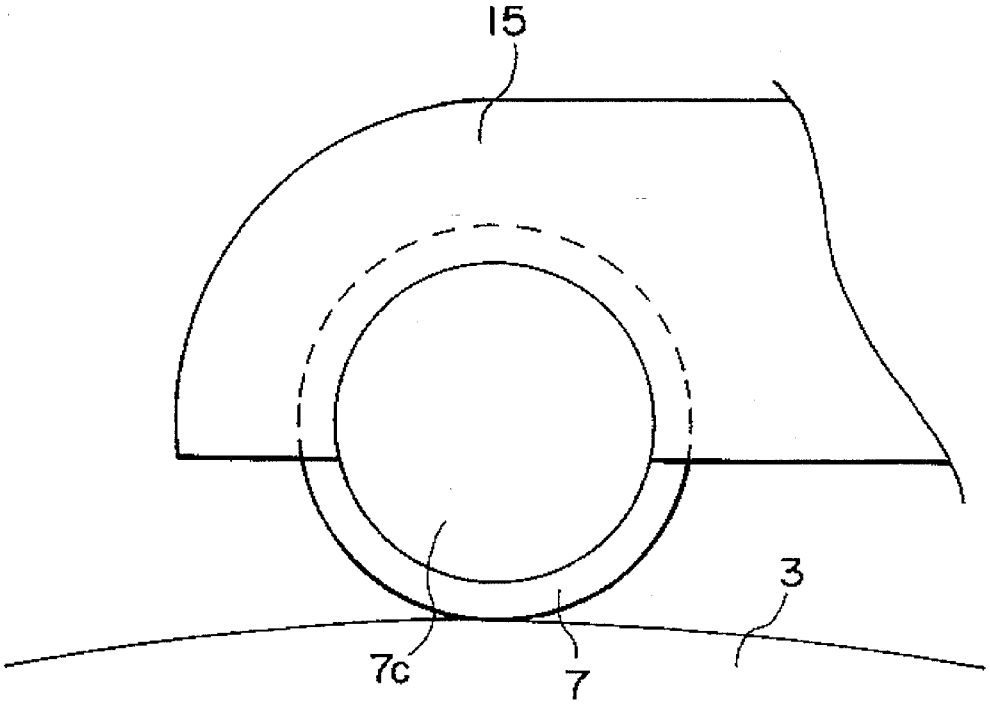
FIGS. 4 and 5 are detailed sectional views showing the first embodiment.
Figure 5:
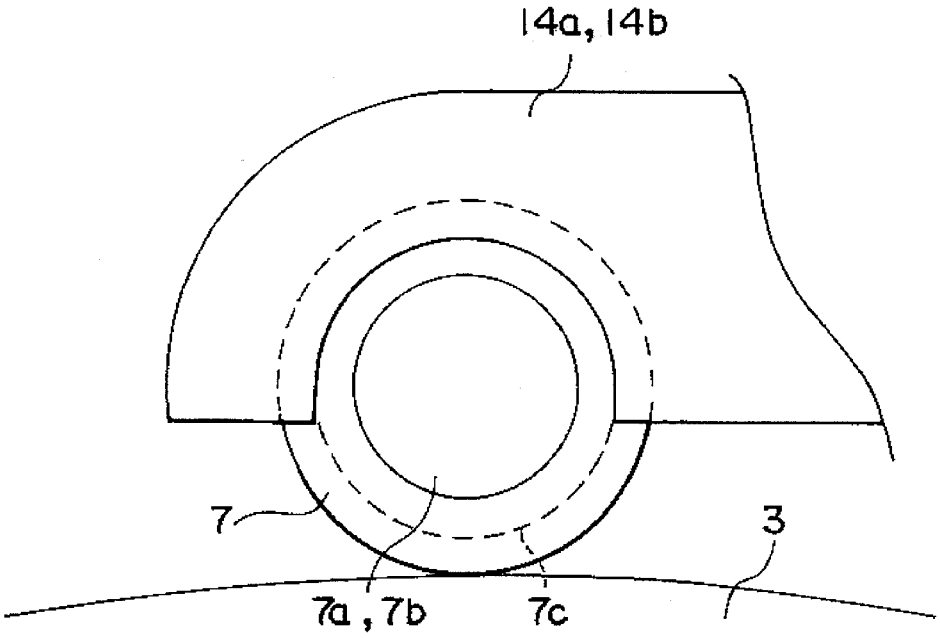

First of all, a first embodiment of the present invention will be explained with reference to the accompanying drawings. FIG. 1 is a perspective view of a recording apparatus to which the present invention is applied, FIG. 2 is an enlarged view of a portion of FIG. 1, FIG. 3 is a side sectional view of the apparatus of FIG. 1, FIG. 4 is a detailed sectional view of a pinch roller holder bearing, and FIG. 5 is a detailed sectional view of retainer members.

Recording sheets 17 stacked on a sheet supply tray 6 of an automatic sheet supply portion 5 are separated one by one by sheet supply rollers 8, and the separated recording sheet is guided between a sheet guide 13 and pinch roller holders 4 and then is sent to a convey roller 3 of a recording portion 1. In this case, since the pinch roller holders 4 serve as guide for holding down the recording sheet 17 to prevent the recording sheet from floating, the recording sheet 17 is surely sent to between the convey roller 3 and pinch rollers 7. Each pinch roller 7 has a central small diameter shaft 7*c*. Each small diameter shaft 7*c* is rotatably supported by a corresponding pinch roller bearing 15 positioned at a central portion of the pinch roller holder 4. Each pinch roller 7 is supported at the central position alone. Incidentally, each pinch roller 7 may not have the central small diameter shaft and have the same diameter in its whole length.

A spring member 9 urges the corresponding pinch roller bearing 15. Further, retainer members 14*a*, 14*b* for maintaining the parallelism between the convey roller 3 and the pinch roller 7 in a plane flush with a surface of the recording sheet and the parallelism therebetween in a direction perpendicular to the surface of the recording sheet within a certain play range are arranged at left and right ends of the pinch roller holder 4. The retainer members 14*a*, 14*b*, which serve as shift regulation means, keep the small diameter shaft 7*c* with a predetermined play.

Since any play regarding the parallelism in the plane flush with the surface of the recording sheet affects a bad influence upon the accuracy of a recording start position with respect to the recording sheet, such play is desired to be zero. However, for example, even if there is the play of 0.1–0.2 mm along the whole length (of 40 mm) of the pinch roller 7, any problem will not occur. Further, since the play regarding the parallelism in the direction perpendicular to the surface of the recording sheet serves to suppress the movability of the pinch roller, such play may be about 0.1–1.0 mm. Since each pinch roller holder 4 mounted on a chassis 16 for free rotational movement with respect to the convey roller 3, the pinch roller 7 is urged against the convey roller 3 via the pinch roller bearing 15 by an urging force of the spring member 9.

A surface of the convey roller 3 is formed from material having high coefficient of friction such as rubber or urethane, and the convey roller cooperates with the pinch rollers to pinch the recording sheet therebetween and is rotated by a drive source (not shown) to sent the recording sheet onto a platen 12, where an image is recorded on the recording sheet by a recording head 2. The recording sheet on which the image was recorded is discharged onto a discharge portion 23 by discharge rollers 10, 11. Incidentally, the recording head 2 may be an ink jet recording head for recording the image by discharging ink from nozzles due to the growth of bubbles generated in the ink by means of heat generating means.

Figure 6:
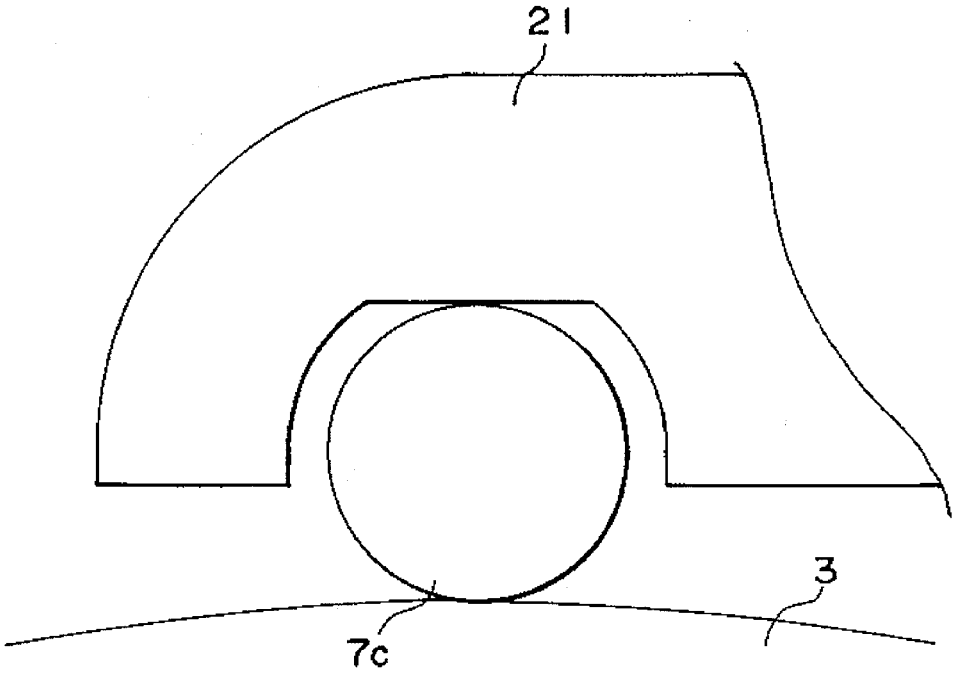
FIGS. 6 and 7 are detailed sectional views showing a second embodiment of the present invention.
Figure 7:
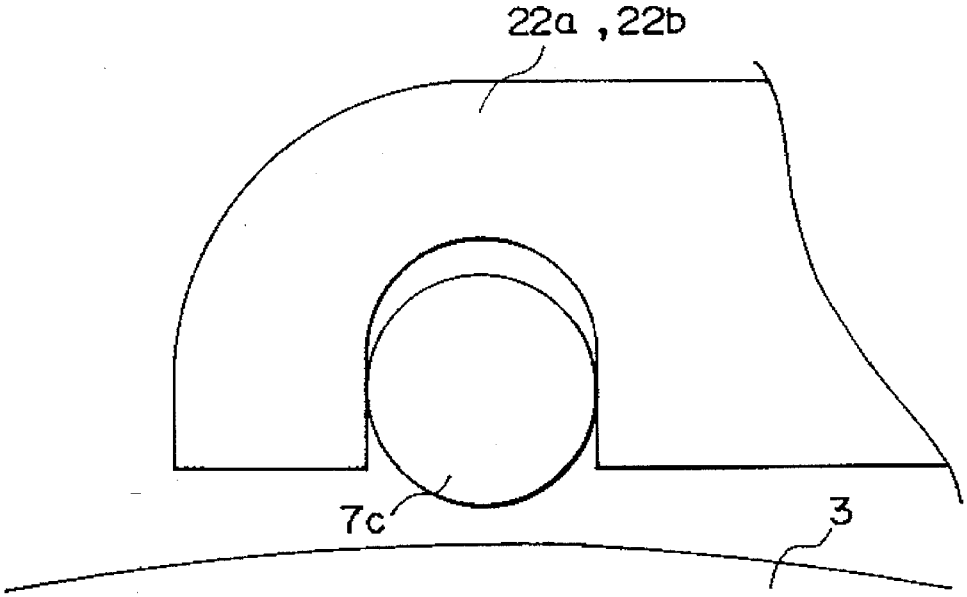

Next, a second embodiment of the present invention will be explained with reference to FIGS. 6 and 7.

Similar to the first embodiment, each pinch roller 7 is urged by the corresponding spring member 9 at its central portion. In this second embodiment, each pinch roller 7 is regulated by a member 21 disposed at the urging position for the pinch roller only in the direction perpendicular to the surface of the recording sheet (FIG. 6 is a sectional view of such member). Further, in this second embodiment, the parallelism regarding the surface of the recording sheet is regulated only by members 22*a*, 22*b* arranged at left and right ends of the pinch roller holder 4 (FIG. 7 is a detailed description view of such members). That is to say, since each pinch roller is positioned by three members 21, 22*a*, 22*b* arranged at three points on the corresponding pinch roller holder and the alignment of the pinch roller is permitted without increasing the sliding resistance, the same technical advantage as the first embodiment can be obtained.

Figure 8:
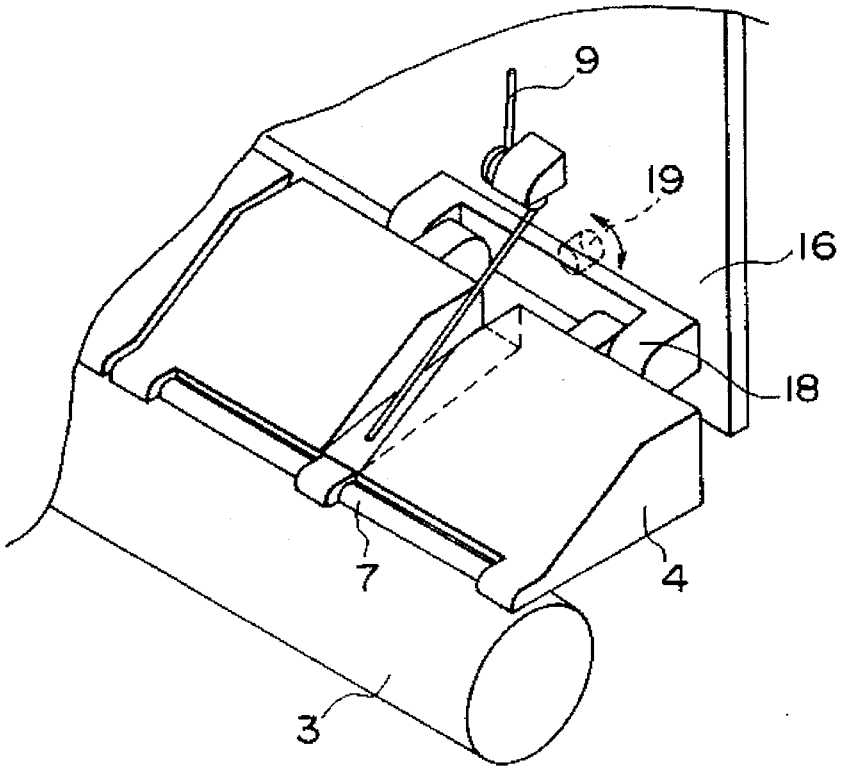
FIG. 8 is a schematic perspective view showing a third embodiment of the present invention.
Figure 9:
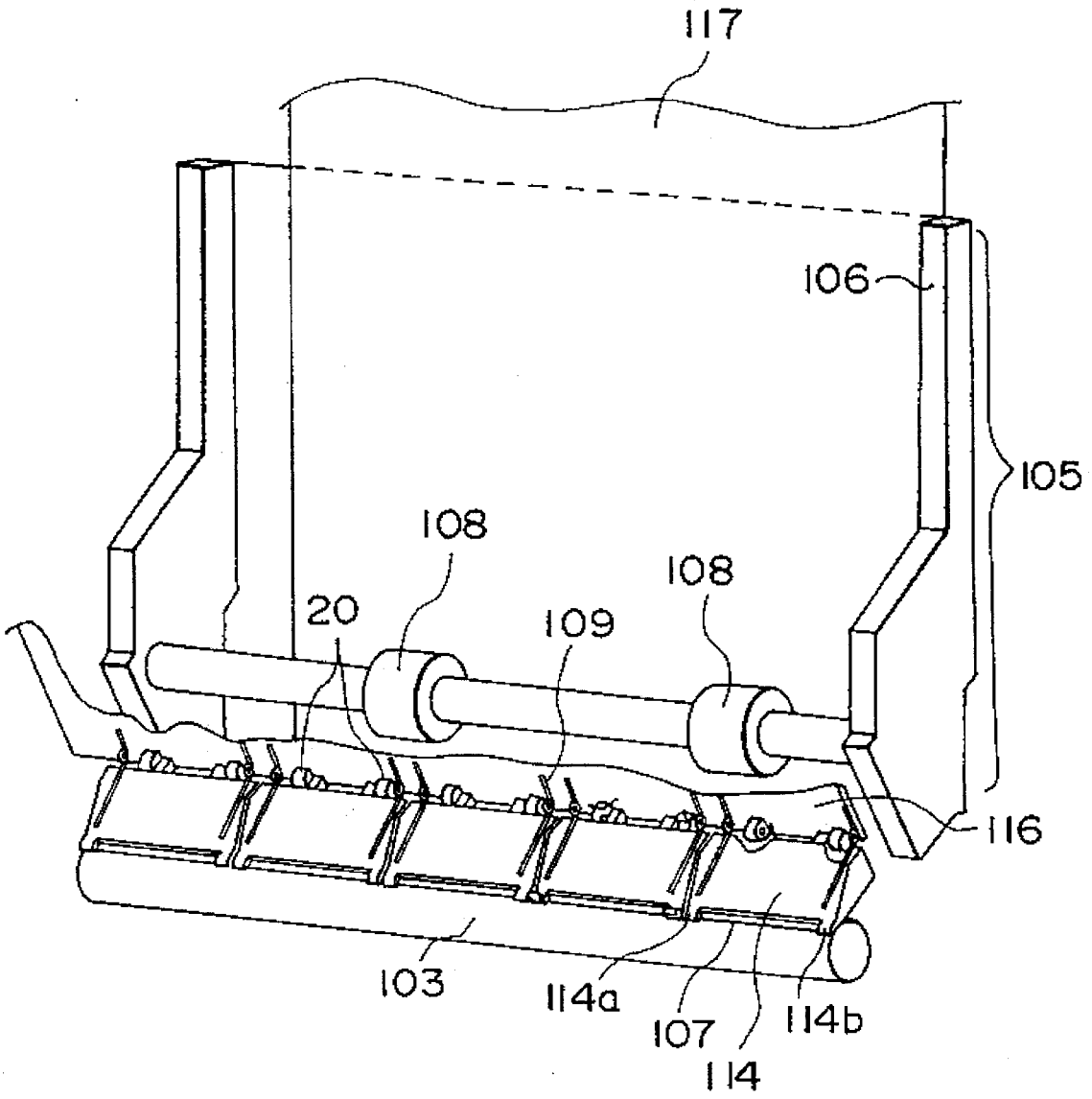
FIG. 9 PRIOR ART
FIG. 9 is a schematic perspective view of a conventional recording apparatus.

Lastly, a third embodiment of the present invention will be explained with reference to FIG. 8.

Each pinch roller holder 4 is rotatably mounted on a corresponding bearing plate 18 via a shaft. The bearing plate 18 is mounted on a shaft 19 for rotational movement in directions shown by the arrow with respect to the convey roller 3. With this arrangement the alignment of the pinch roller holder 4 with respect to the convey roller 3 is permitted, with the result that the pinch roller 7 supported by the pinch roller holder can be aligned in accordance with the movement of the pinch roller holder 4. Bearings for the pinch roller 7 may be arranged on both left and right ends. In this case, although the pinch roller is urged against the convey roller by the spring members 9 at both left and right ends, the pinch roller 7 can be aligned together with the pinch roller holder 4 with respect to the convey roller 3, thereby obtaining the same conveying ability for the recording sheet as the aforementioned embodiments.

As mentioned above, according to the present invention, it is possible to make the urging forces of the pinch rollers against the convey roller uniform without increasing the rotational resistance of the pinch rollers, and, thus, to prevent the skew-feed of the recording sheet.

What is claimed is:

1. A sheet conveying apparatus, comprising:

a conveyor roller for applying a convey force to a sheet by contacting with the sheet while rotating;

a pinch roller for conveying the sheet by cooperating with said conveyor roller;

support means for supporting said pinch roller at a central portion in a widthwise direction thereof;

urge means for urging said pinch roller via said support means so that said pinch roller is pressed against said conveyor roller; and shift regulation means for regulating shifting of said pinch roller in such a manner that an end of said pinch roller can be shifted freely in a predetermined range.

2. A sheet conveying apparatus according to claim 1, wherein an urge force of said urge means acts only onto the center of said pinch roller in widthwise direction thereof.

3. A sheet conveying apparatus according to claim 1, wherein said shift regulation means is provided with a shift regulating portion for regulating shift of said pinch roller at both ends of said pinch roller.

4. A sheet conveying apparatus according to claim 3, wherein said shift regulating portion permits the movement of said pinch roller within a predetermined range.

5. A sheet conveying apparatus according to claim 1, wherein at least two pinch roller is provided.

6. A sheet conveying apparatus according to claim 1, wherein said pinch roller urges the sheet along substantially an entire width thereof.

7. A sheet conveying apparatus according to claim 1, wherein said support means is rockably supported, and a bearing portion for pivoting the center of said pinch roller is formed at a rocking end thereof.

8. A sheet conveying apparatus according to claim 7, wherein said urging means urges said pinch roller via said bearing portion.

9. An image forming apparatus, comprising:

a conveyor roller for applying a convey force to a sheet by contacting with the sheet while rotating;

a pinch roller for conveying the sheet by cooperating with said conveyor roller;

a support means for supporting said pinch roller at a central portion in a widthwise direction thereof;

urge means for urging said pinch roller via said support means so that said pinch roller is pressed against said conveyor roller;

shift regulation means for regulating shift of said pinch roller in such a manner that an end of said pinch roller can be shifted freely in a predetermined range; and image forming means for forming an image on the sheet conveyed by said conveyor roller and said pinch roller.

10. An image forming apparatus according to claim 9, wherein said image forming means forms the image by discharging an ink droplet onto the sheet.

11. An image forming apparatus according to claim 10, wherein said image forming means generates a bubble in ink by utilizing thermal energy to thereby discharge the ink by the growth of it.

12. A sheet conveying apparatus, comprising:

a conveyor roller for applying a convey force to a sheet by contacting with the sheet while rotating;

a pinch roller for conveying the sheet by cooperating with said conveyor roller;

urge means for urging said pinch roller at a central portion in a widthwise direction thereof without urging both ends of said pinch roller so that said pinch roller is pressed against said conveyor roller; and shift regulation means for regulating shifting of said pinch roller in such a manner that an end of said pinch roller can be shifted freely in a predetermined range.

13. A sheet conveying apparatus according to claim 12, wherein an urge force of said urge means acts only onto the center of said pinch roller in widthwise direction thereof.

14. A sheet conveying apparatus according to claim 12, wherein said shift regulation means is provided with a shift regulating portion for regulating shift of said pinch roller at both ends of said pinch roller.

15. A sheet conveying apparatus according to claim 14, wherein said shift regulating portion permits the movement of said pinch roller within a predetermined range.

16. A sheet conveying apparatus according to claim 12, wherein at least one additional pinch roller, urge means and shift regulation means are provided.

17. A sheet conveying apparatus according to claim 12, wherein said pinch roller urges the sheet along substantially an entire width thereof.

18. A sheet conveying apparatus according to claim 12, further comprising support means for supporting the pinch roller, wherein said support means is rockably supported, and a bearing portion for pivoting the center of said pinch roller is formed at a rocking end thereof.

19. A sheet conveying apparatus according to claim 18, wherein said urging means urges said pinch roller via said bearing portion.

20. An image forming apparatus, comprising:

a conveyor roller for applying a convey force to a sheet by contacting with the sheet while rotating;

a pinch roller for conveying the sheet by cooperating with said conveyor roller;

urge means for urging said pinch roller at a central portion in a widthwise direction thereof without urging both ends of said pinch roller so that said pinch roller is pressed against said conveyor roller;

shift regulation means for regulating shifting of said pinch roller in such a manner that an end of said pinch roller can be shifted freely in a predetermined range; and image forming means for forming an image on the sheet conveyed by said conveyor roller and said pinch roller.

21. An image forming apparatus according to claim 20, wherein said image forming means forms the image by discharging an ink droplet onto the sheet.

22. An image forming apparatus according to claim 21, wherein said image forming means generates a bubble in ink by utilizing thermal energy to thereby discharge the ink by the growth of it.

23. A sheet conveying apparatus, comprising:

a conveyor roller for applying a convey force to a sheet by contacting with the sheet while rotating;

a pinch roller for conveying the sheet by cooperating with said conveyor roller;

support means for supporting said pinch roller at a central portion in a widthwise direction thereof; and shift regulation means for regulating shifting of said pinch roller in such a manner that an end of said pinch roller can be shifted freely in a predetermined range.

24. A sheet conveying apparatus according to claim 23, further comprising urge means for urging said pinch roller via said support means so that said pinch roller is pressed against said conveyor roller.

25. A sheet conveying apparatus according to claim 24, wherein an urge force of said urge means acts only onto the center of said pinch roller in widthwise direction thereof.

26. A sheet conveying apparatus according to claim 23, wherein said shift regulation means is provided with a shift regulating portion for regulating shift of said pinch roller at both ends of said pinch roller.

27. A sheet conveying apparatus according to claim 26, wherein said shift regulating portion permits the movement of said pinch roller within a predetermined range.

28. A sheet conveying apparatus according to claim 23, wherein at least one additional pinch roller, urge means and shift regulation means are provided.

29. A sheet conveying apparatus according to claim 23, wherein said pinch roller urges the sheet along substantially an entire width thereof.

30. A sheet conveying apparatus according to claim 23, wherein said support means is rockably supported, and a bearing portion for pivoting the center of said pinch roller is formed at a rocking end thereof.

31. A sheet conveying apparatus according to claim 30, wherein said urging means urges said pinch roller via said bearing portion.

32. An image forming apparatus, comprising:

a conveyor roller for applying a convey force to a sheet by contacting with the sheet while rotating;

a pinch roller for conveying the sheet by cooperating with said conveyor roller;

support means for supporting said pinch roller at a central portion in a widthwise direction thereof;

shift regulation means for regulating shifting of said pinch roller in such a manner that an end of said pinch roller can be shifted freely in a predetermined range; and image forming means for forming an image on the sheet conveyed by said conveyor roller and said pinch roller.

33. An image forming apparatus according to claim 32, wherein said image forming means forms the image by discharging an ink droplet onto the sheet.

34. An image forming apparatus according to claim 33, wherein said image forming means generates a bubble in ink by utilizing thermal energy to thereby discharge the ink.

35. A sheet conveying apparatus, comprising:

a first rotary member for applying a convey force to a sheet by rotating contact with the sheet;

a second rotary member having two end portions for conveying the sheet cooperating with said first rotary member;

a spring for urging a central portion of said second rotary member without urging both end portions thereof; and a shift regulation member for regulating said second rotary member so that an end portion of said second rotary member can freely shift in a predetermined range.

36. A sheet conveying apparatus according to claim 35, further comprising a support member supported rockably, and provided with a bearing portion rotatably supporting the central portion of said pinch roller at a rocking portion thereof.

37. A sheet conveying apparatus according to claim 36, wherein said spring is constructed as to urge said second rotary member via the bearing portion.

38. A sheet conveying apparatus according to claim 35, further comprising image formation means for forming an image on the sheet conveyed by said first and second rotary member.

39. A sheet conveying apparatus according to claim 38, wherein said image formation means forms the image by jetting ink to the sheet.

40. A sheet conveying apparatus according to claim 39, wherein said image formation means forms the image by generating bubbles by thermal energy to jet the ink to the sheet by expansion of the ink.

* * * * *

UNITED STATES PATENT AND TRADEMARK OFFICE

CERTIFICATE OF CORRECTION

PATENT NO. : 5,540,427
DATED : July 30, 1996
INVENTOR(S) : TETSUHIRO NITTA, ET AL.

It is certified that error appears in the above-indentified patent and that said Letters Patent is hereby corrected as shown below:

Item [75],
line Inv., "Yasuhimo Unosawa" should read --Yasuhiro Unosawa--.
Item [56] RC,
line FPD, "3293242 12/1991 Japan" should read --3-293242 12/1991 Japan--.
Item [57] ABSTRACT,
line 7, "means" should be deleted.
Column 1,
line 67, "is" should be deleted.
Column 3,
line 38, "sent" should read --send--.
Column 4,
line 46, "roller is" should read --rollers are--.

Signed and Sealed this

Twenty-sixth Day of November 1996

*Attest:*

Bruce Lehman

BRUCE LEHMAN

*Attesting Officer*

*Commissioner of Patents and Trademarks*